US005556103A

United States Patent [19]

Quetglas Ariño

[11] Patent Number: 5,556,103

[45] Date of Patent: Sep. 17, 1996

[54] STRUCTURE OF DARTBOARDS

[76] Inventor: Miguel A. Quetglas Ariño, Pol. Ind. "Can Magi" c/Joan Buscalla, Nave 1 A E-08190 Sant Cugat (Barcelona), Spain

[21] Appl. No.: 467,879

[22] Filed: Jun. 6, 1995

[30] Foreign Application Priority Data

Jun. 21, 1994 [ES] Spain ..... P9401397
Jul. 13, 1994 [ES] Spain ..... P9401600

[51] Int. Cl.[6] ..... F41J 3/00; F41J 3/02

[52] U.S. Cl. ..... 273/371; 273/374

[58] Field of Search ..... 273/371, 372, 273/373, 374, 376, 327, 85 G, DIG. 28, 460

[56] References Cited

U.S. PATENT DOCUMENTS

| | | | |
|---|---|---|---|
| 2,168,644 | 8/1939 | Browning . | |
| 3,229,975 | 1/1966 | Tompkins | 273/371 |
| 3,499,651 | 3/1970 | Hubbard | 273/373 |
| 3,836,148 | 9/1974 | Manning | 273/371 |
| 4,415,162 | 11/1983 | Sheppard | 273/371 |
| 4,793,618 | 12/1988 | Tillery et al. . | |
| 4,824,121 | 4/1989 | Beall et al. . | |
| 5,358,253 | 10/1994 | Chen | 273/371 |

FOREIGN PATENT DOCUMENTS

| | | |
|---|---|---|
| 444641 | 2/1942 | Belgium . |
| 2130107 | 11/1982 | United Kingdom . |

*Primary Examiner*—Sebastiano Passaniti
*Attorney, Agent, or Firm*—Dennison, Meserole, Pollack & Scheiner

[57] ABSTRACT

Improvements in the structure of electronic dartboards in which inside each sector-division and in distinct regions thereof there are lights of different colors, the internal lights being controlled by an additional electric circuit connected to the logic board of the electronic dartboard, which are seen through the holes in the front wall of each sector-division, the electrical connection is achieved by a change generated in the electrical resistance, the light source being provided in the rear portion of the rigid support, transparent, so that the light passes through the transparent board for electrical circuits printed, the playing area being illuminated owing to transparency from the bottom of the body of the playing area of the board to its final transparency stage and subsequently directly illuminating the internal front wall of the box and emerging to the exterior, filtered through the plurality of holes therein.

3 Claims, 2 Drawing Sheets

STRUCTURE OF DARTBOARDS

BACKGROUND OF THE INVENTION

The present patent relates to some improvements in the structure of dartboards.

Currently, electronic dartboards are known which are formed by a plurality of sectors of a suitable triangular shape, each defining a box of which the rear portion is uncovered and the covered front base has a plurality of through-holes which connect the exterior of the box with its interior.

In their edges defining the mouth of the chamber, these sectors have perpendicular projections which, when the sector moves backwards owing to the force of the impact upon being struck by the tip of the dart thrown by the player, actuate rigid push-buttons which press against corresponding contact points of a facing rear electric contact plate.

In addition to the elements referred to, this sandwiched connector has an opaque, resilient, preferably elastomeric, laminar pad for absorbing the shock of the impact of the sharp tip of the dart to prevent it from striking the rigid printed electrical-contact board and destroying it.

The playing area described is disposed against the vertical panel of the games machine and the panel has windows for showing writing and numerals relating to various different situations which arise during the development of the game selected by the player, up to its final result.

Changes take place in the content of these written and/or numerical notices, which are situated on the support panel of the board and thus outside the area which receives the darts thrown by the players, as they appear in the windows, their appearance being arranged by the logic board (1) of the electronic dartboard by means of the monitoring circuit (2) for controlling the situation of the displays, to which it sends corresponding signals.

The writing which appears in the windows in the top part of the support of the dartboard and outside its playing area during the development of the game is difficult for the players to read and interpret because of the distance between the point at which the dart is released by the player and the board.

This causes errors of interpretation and consequently has an adverse effect on the development of the game.

The closure of the electrical circuit therefore occurs when the perpendicular, horizontal projection of the edge of the mouth of the chamber defined by each box strikes the "plot" of the contact board during the rearward movement of the box brought about by the force of the impact of the dart thrown by the player, the box moving rearwardly and the perpendicular projections striking the corresponding "plots" of the contact board with the mechanical action of an electrical switch, opening the electrical circuit.

Known dartboards physically constructed in this manner have to be illuminated from outside their playing areas so that the development of the game can be observed when these boards are placed in enclosed areas such as an inn, a games room, a hotel hall, etc. in which small useless spaces are usually utilized for the installation of these machines.

In some cases, as well as being narrow, these spaces are out of the way and badly lit. This obliges the manufacturers of dartboards, with or without T.V. screens, to provide lamps for illuminating the playing area of the board, outside the playing area and inside canopies projecting from supporting cabinets which are really narrow cupboards constituting the vertical support for the control console, for the playing area of the board, and for the forwardly-directed perpendicular canopy of the upper edge of the cabinet, and it is in this outer front portion of the canopy that the lamps for illuminating the playing area are situated, their illuminating rays reflecting from the shiny surface of the vertical support and annoying the player, giving rise to visual fatigue during the game.

The particular spatial arrangement of the canopy for the lights for illuminating the playing area of the board in the first place enables the light rays to be directed towards the playing area, thus achieving maximum illumination of this area.

Now, irrespective of the annoying reflection which may arise, this total illumination of the playing area is also enervating since it disturbs the nervous system of the player who has to suffer the constant effect of the external illumination whilst he is playing.

Clearly the provision of the cabinet for housing the lighting outside the playing area of the boards increases the cost of the product because the cost of the cabinet has to be included therein.

Moreover, it is necessary to take account of the generation of dazzling, annoying reflections when the light rays of the external lamps strike the front of the vertical panel with a shiny surface surrounding the playing area of the board, in which panel there is a plurality of windows in which illuminated written and numerical indications concerning the development of the game appear at respective moments, their appearance on the T.V. screen being arranged by the CPU.

SUMMARY OF THE INVENTION

The improvements of the invention have been designed to prevent all of these problems, enabling the electronic dartboard mentioned above to be hung on a wall as desired without the need for a supporting cabinet body and to function with good visibility owing to internal illumination disposed in its own body without disturbing the view of the player and of the spectators located around it and, moreover, with the omission of the cabinet-console which, at the moment, is necessary for achieving external illumination.

By virtue of these improvements the player can also very easily identify visually and without any reading the orientational, luminous message which cannot be tabulated and which the machine transmits to him before starting the game selected from various different options, in relation to one of the various principal regions of the receiving surface of each of the sectors-divisions which together form the playing area of the board.

These various luminous points of different colours are indicative of receiving points which are fair, good, bad or worst for the player, according to the regions for receiving the impact of the darts into which the front portion of each sector-division is divided.

Also, before the game begins, all of the lights which are lit in the sector division corresponding to the various aiming points amongst those which the player may select before starting to throw his dart disappear so that, at the moment when the dart is thrown, all of the lights are switched off and, when the dart strikes the front surface of a sector-division, a single light inside the sector-division of the dartboard of the colour corresponding to the region struck is then lit during the development of the game, the playing area of the board thus acknowledging the impact received and, moreover, indicating visually and by colour difference the sector-division and the region thereof which received it.

On the other hand, the improvements of the invention enable the electronic board to be hung on a wall as desired without the need for a supporting cabinet body and to operate with good visibility owing to internal illumination disposed in its own body without disturbing the view of the player and of the spectators located around it and, moreover, with the omission of the cabinet-console which, at the moment, is provided for supporting the external illumination lamps necessary for achieving external illumination.

Another important factor resulting from the improvements of the invention is that visibility is not achieved by external light beams of constant intensity striking the surface of the playing area but by the combination of light and shade of the light emanating from inside the body of the playing area of the dartboard.

Accordingly, by virtue of the novel structural arrangement of the invention, nervousness of the player brought about by optical fatigue owing to the external light striking the playing area and reflecting into the player's eyes can also be avoided, thus achieving a beneficial, relaxing effect.

BRIEF DESCRIPTION OF THE DRAWINGS

For a correct understanding, a description of a practical embodiment of a dartboard constructed according to these improvements is given by way of a non-limiting example below, accompanied by two sheets of drawings, in which.

DESCRIPTION OF THE PREFERRED EMBODIMENTS

Figure 1:
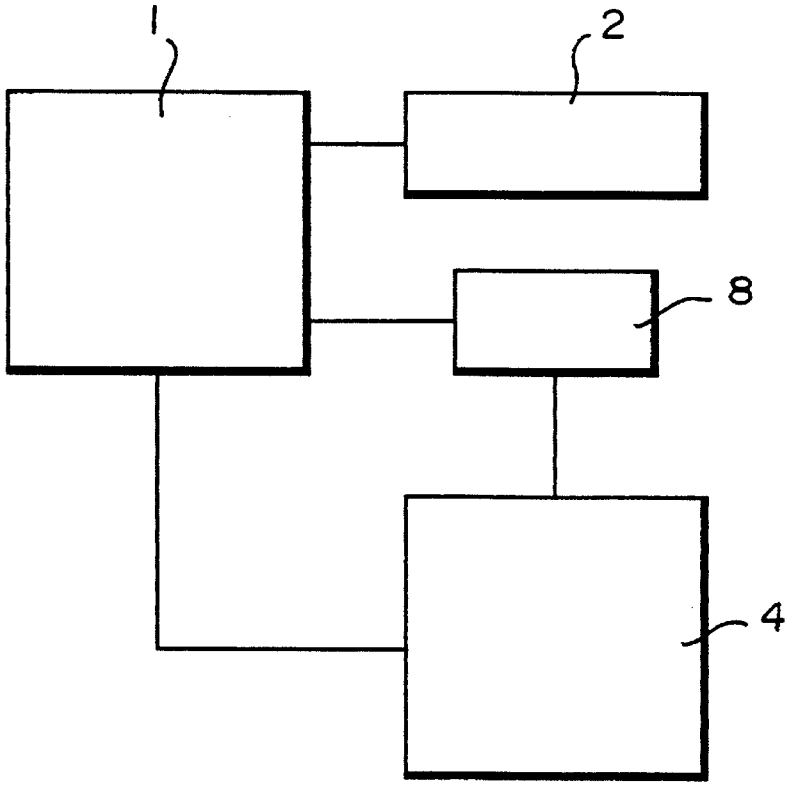
FIG. 1 shows a diagram of a logic board corresponding to the electronic dartboards, with the C.P.U. (1), the display monitoring unit (2) and the electronic dartboard (4), to which a part of the invention, which is the additional circuit (8) for controlling coloured lights (6) disposed at certain points in the internal chamber of each sector-division (3), is joined.
Figure 2:
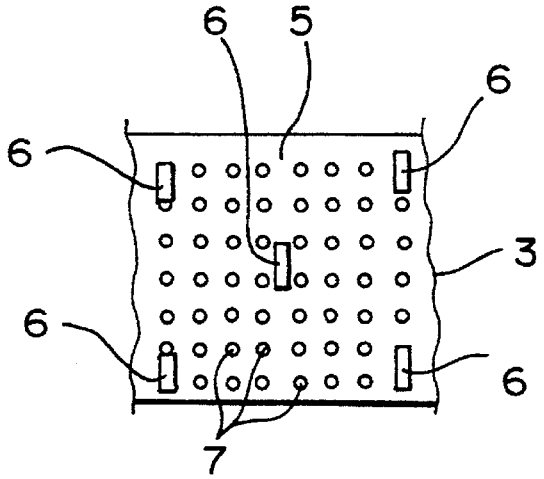
FIG. 2 is part of the internal surface of the front wall of a sector-chamber which is an integral part of the playing area of the board. In addition to the perpendicular holes of dartboards of this type, the rest of the invention, consisting of the arrangement of incandescent lamps "leds" (6) is shown on this internal surface, in relation to the additional light circuit (8) mentioned above.
Figure 3:
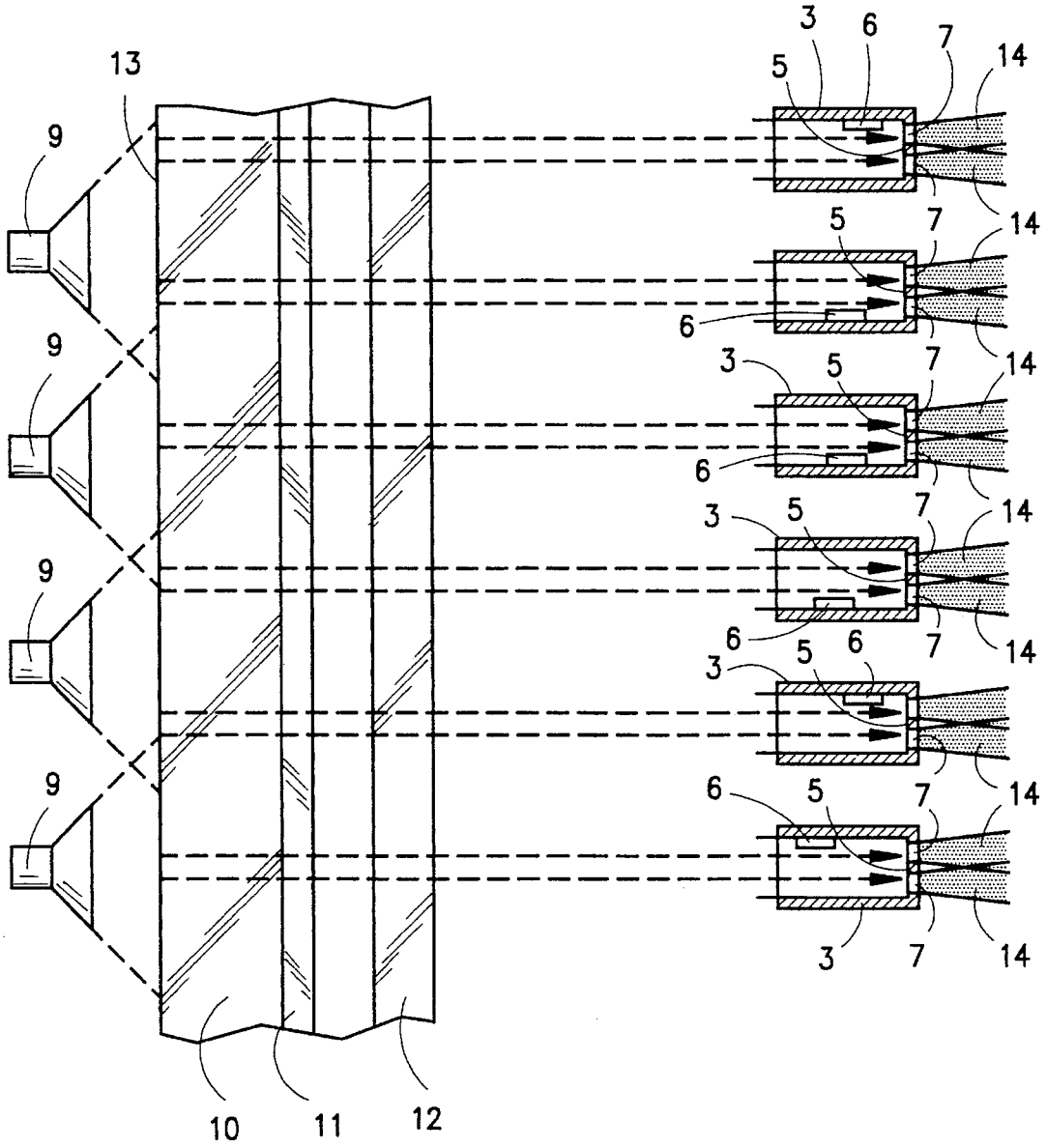
FIG. 3 shows schematically, divided into their constituent parts and in line, separate segment-boxes and additional elements of the board produced according to the present improvements.

The invention consists of the fact that, inside the hollow chamber which constitutes each of the sectors-divisions which together form the actual body of the board (4), are disposed and fixed to the rear surface of the front (5) of each sector, incandescent lights (6) such as "leds" of different colours according to the regions considered good, fair, bad or worst for the player, the lights forming part of an additional electronic circuit connected to the C.P.U. (1) of the electronic dartboard (4) so that, before each player starts to play, all of the lights disposed inside each sector-division indicate, when lit, regions of good, fair or bad positions for receiving the dart to be thrown, according to the corresponding colour.

Once the player has been informed and before he starts to play, the CPU (1) then switches off the lights (6) so that no light is lit in any of the sectors-divisions (3) and when the dart strikes the region of the front surface of a sector-division, the internal light of the colour corresponding to that region is lit selectively, enabling the player to see the internal coloured light radiated by the incandescent lamp of the internal regional light through the holes (7) in the front wall of the chamber of the sector division (3) which, together with the rest of the sector-divisions, constitutes the playing area of the board (4).

Before play starts, these lights (6) are kept lit for a moderate time for the player to memorize his position inside each sector-division and serve him as an aiming point for the dart to be thrown which, when play has reached this stage, then causes only the light of the colour corresponding to the zone struck to be lit.

Moreover, in addition to the lights (6) disposed inside each of the sector-divisions (3) which make up the playing area of the board (4) connected to the logic board of the electronic dartboard there is an electrical circuit (8) which transmits the signals emitted by the CPU (1) and sends them to the control unit (2) for monitoring the incandescent lamps (6).

The incandescent lamps are preferably "leds".

As indicated above, these improvements of the invention which are introduced into the structure of dartboards of the type comprising a vertical support cabinet the upper portion of which supports a forwardly-projecting, perpendicular canopy in which there are lamps for the external illumination of the playing area which is constituted by a plurality of individually rearwardly-displaceable sectors with horizontal, perpendicular projections in the edges of the chamber which forms each box, with a front wall complete with a plurality of through holes, and an opaque board for an opaque printed circuit, an opaque, resilient shock-absorbing pad and a common rear support which is also opaque, the electrical connection of which is brought physically to the opened or closed configuration when the horizontal, perpendicular projections of the rear edges of each segment-box strike and press against the opaque "plots", the connections being connected by physical contact by a mechanical switch action and being transmitted to the control unit of the machine, with or without a T.V. screen, and a vertical shiny panel for housing the playing area, the vertical shiny panel having windows which are lit and through which writing and numerals relating to the progress of the game appear, are characterized in that the physical contact of the perpendicular projections of the edge of the mouth of the chamber which forms each box-segment (3) of the playing area is replaced by a change generated in the electrical resistance, the light source (9) being provided in the rear portion of the rigid support (10) which, in this case, is transparent, so that the light passes through the transparent board (11) for electrical circuits printed in transparent ink and the transparent shock-absorbing plate (12), and the electrical connection is achieved by a change in the electrical resistance whilst the playing area is illuminated owing to transparency to the light passing from the bottom (13) of the body of the playing area of the board to its final transparency stage, depleted after passing through the transparent shock-absorber (12) and subsequently directly illuminating the internal front wall (5) of a sector-chamber or box (3) and emerging to the exterior, filtered (14) through the plurality of holes (7) therein, its emergence being interrupted in the regions in which the opaque ribs of the concentric circles and the radial arms defining the playing area of the dartboard are diposed.

Upon playing with the electronic dartboards thus illuminated, the player thus utilizes perfect internal filtered light illuminating the playing area of the dartboard, without any external light.

It is understood that all details of execution of the present embodiment may be varied without altering, changing or modifying the essence of the invention.

I claim:

1. Improvements in the structure of a dartboard of the type in which a playing area of the dartboard comprises a plurality of sector divisions with front walls having a plurality of evenly distributed holes provided by a plurality of individual rearwardly displaceable sector boxes each with a front wall with a plurality of through holes comprising a portion of said evenly distributed holes, each of said boxes having a rearwardly opening internal chamber and a rear edge thereabout, and rearwardly extending projections on said rear edge, said playing area, rearward of said boxes, having a body comprising a board with a printed circuit, a resilient, shock-absorbing pad and a common rear support, an electrical connection being established by rearward movement of said projections on the rear edge of each sector box; wherein inside each sector division and in distinct regions defined thereby are lights of different colors indicative of different value receiving areas, the lights being controlled by an electric circuit connected to a logic board of the dartboard which, before the start of the game, brings about simultaneous lighting of the lights as an aiming point, said lights protecting illumination visible through the holes in the front wall of each sector box, the illumination disappearing immediately before the throwing of the dart in play, and, once in play, single colored lights, corresponding to the sector boxes struck by darts illuminating and being visible forward of the dartboard through the holes in the front walls of the struck sector boxes.

2. Improvements in the structure of a dartboard according to claim 1, in which the lights are provided rearward of the rear support, said rear support, printed circuit and circuit board, and resilient pad being transparent, the playing area having portions thereof selectively illuminated, owing to this transparency, from the rear of the body of the playing area, subsequently the illumination illuminating the front walls of the boxes as such boxes are struck by darts, the illumination emerging forwardly through the plurality of holes therein.

3. Improvements in the structure of a dartboard according to claim 1 in which the lights are individually mounted within said sector box chambers and, upon illumination, project light forwardly through the holes in the front walls of the corresponding boxes for a selective illumination of the playing area from lights internal thereof.

* * * * *

UNITED STATES PATENT AND TRADEMARK OFFICE

CERTIFICATE OF CORRECTION

PATENT NO. : 5,556,103

DATED : September 17, 1996

INVENTOR(S) : Miguel Angel QUETGLAS ARINO

It is certified that error appears in the above-indentified patent and that said Letters Patent is hereby corrected as shown below:

Column 6, line 2, "protecting" should be --projecting--.

Signed and Sealed this

Twelfth Day of November, 1996

*Attest:*

Bruce Lehman

BRUCE LEHMAN

*Attesting Officer*

*Commissioner of Patents and Trademarks*